US010006185B2

(12) United States Patent
Tomchesson et al.

(10) Patent No.: US 10,006,185 B2
(45) Date of Patent: Jun. 26, 2018

(54) HELICAL PILE ASSEMBLY WITH TOP PLATE

(71) Applicant: TorcSill Foundations, LLC, Pasadena, TX (US)

(72) Inventors: Jimmy B. Tomchesson, Richmond, TX (US); Rex E. Hallman, Friendswood, TX (US); Lyle G. Love, Weatherford, OK (US)

(73) Assignee: TORCSILL FOUNDATIONS, LLC, Pasadena, TX (US)

( * ) Notice: Subject to any disclaimer, the term of this patent is extended or adjusted under 35 U.S.C. 154(b) by 5 days.

(21) Appl. No.: 14/738,501

(22) Filed: Jun. 12, 2015

(65) Prior Publication Data

US 2016/0186402 A1 Jun. 30, 2016

Related U.S. Application Data

(60) Provisional application No. 62/097,708, filed on Dec. 30, 2014.

(51) Int. Cl.

| | |
|---|---|
| ***E02D 5/52*** | (2006.01) |
| ***E02D 5/56*** | (2006.01) |
| ***E02D 5/22*** | (2006.01) |
| ***E02D 5/54*** | (2006.01) |
| ***E02D 7/22*** | (2006.01) |
| ***E02D 13/00*** | (2006.01) |
| ***E02D 27/12*** | (2006.01) |
| ***E02D 5/80*** | (2006.01) |

(52) U.S. Cl.

CPC ..... *E02D 5/526* (2013.01); *E02D 5/223* (2013.01); *E02D 5/54* (2013.01); *E02D 5/56* (2013.01); *E02D 5/801* (2013.01); *E02D 7/22* (2013.01); *E02D 13/00* (2013.01); *E02D 27/12* (2013.01)

(58) Field of Classification Search

CPC ..... E02D 5/223; E02D 5/523; E02D 5/526; E02D 5/56; E02D 35/00

USPC ..... 405/255

See application file for complete search history.

(56) References Cited

U.S. PATENT DOCUMENTS

| | | | | |
|---|---|---|---|---|
| 367,411 | A * | 8/1887 | Kilmer | E04H 12/2215 52/154 |
| 3,295,274 | A | 1/1967 | Fulton | |
| 3,710,523 | A | 1/1973 | Taylor | |

(Continued)

FOREIGN PATENT DOCUMENTS

| | | | |
|---|---|---|---|
| JP | 5-65714 | A | 3/1993 |
| JP | 2004011343 | A | 1/2004 |
| KR | 1191289 | B1 | 10/2012 |

OTHER PUBLICATIONS

Non-Final Office Action dated Aug. 4, 2016, U.S. Appl. No. 14/738,528, filed Jun. 12, 2015, pp. 1-14.

(Continued)

*Primary Examiner* — Tara Leigh Mayo-Pinnock

(74) *Attorney, Agent, or Firm* — MH2 Technology Law Group LLP

(57) ABSTRACT

A helical pile assembly includes a plate and a rod extending from the plate. The rod includes threads. A piling is configured to be disposed in the ground and support a load. A connection device is positioned around the rod and configured to transmit torque to the piling. The connection device includes threads that are configured to engage the threads of the rod.

11 Claims, 14 Drawing Sheets

(56) References Cited

U.S. PATENT DOCUMENTS

| | | | |
|---|---|---|---|
| 4,756,129 | A | 7/1988 | Webb |
| 4,833,846 | A | 5/1989 | McFeetors |
| 4,858,876 | A | 8/1989 | Moreno |
| 5,800,094 | A | 9/1998 | Jones |
| 5,980,162 | A | 11/1999 | McCown |
| 6,263,622 | B1 | 7/2001 | Griffin |
| 6,352,390 | B1 | 3/2002 | Jones |
| 6,352,391 | B1 | 3/2002 | Jones |
| 6,394,704 | B1 | 5/2002 | Saeki |
| 6,682,267 | B1 | 1/2004 | Jones |
| 6,817,810 | B2 | 11/2004 | Jones |
| 7,037,045 | B2 | 5/2006 | Jones |
| 8,156,695 | B2 | 4/2012 | Smith |
| 8,402,837 | B1 | 3/2013 | Jones et al. |
| 8,407,949 | B2 | 4/2013 | Kellner |
| 9,027,898 | B1 | 5/2015 | Holmboe |
| 9,115,478 | B2 | 8/2015 | Lutenegger |
| 2002/0018698 | A1* | 2/2002 | Lolli ..... E02D 5/56 405/232 |
| 2004/0076479 | A1 | 4/2004 | Camilleri |
| 2010/0143048 | A1* | 6/2010 | Lin ..... E02D 5/523 405/244 |
| 2011/0036025 | A1 | 2/2011 | Boulay |
| 2011/0194901 | A1 | 8/2011 | Jones |
| 2011/0229272 | A1 | 9/2011 | Lindsay |
| 2011/0252722 | A1* | 10/2011 | Laurin ..... E02D 27/32 52/126.6 |
| 2014/0356076 | A1* | 12/2014 | Hale ..... E02D 5/223 405/255 |
| 2014/0363238 | A1* | 12/2014 | Subitoni ..... E02D 7/22 405/252.1 |

OTHER PUBLICATIONS

Final Office Action dated Feb. 16, 2017, U.S. Appl. No. 14/738,528, filed Jun. 12, 2015, pp. 1-16.

* cited by examiner

HELICAL PILE ASSEMBLY WITH TOP PLATE

CROSS-REFERENCE TO RELATED APPLICATIONS

This application claims priority to U.S. Provisional Patent Application No. 62/097,708, which was filed on Dec. 30, 2014, and is incorporated herein by reference in its entirety.

BACKGROUND

A helical pile is a screw-in piling used for foundational support. For example, helical piles have been used in the construction industry to support buildings, towers, and other permanent structures. Helical piles are now also being used in the oil and gas industry such as at a refinery, cracker plant sites, and foundation support for pumping units, production equipment, pipelines, related gas distribution systems, and protective structures. The oil and gas industry has different requirements for a foundation support as compared to a typical building construction foundation support. Thus, there is a need for a helical pile assembly that is configured to be used in the oil and gas industry.

SUMMARY

A helical pile assembly is disclosed. The helical pile assembly includes a plate and a rod extending from the plate. The rod includes threads. A piling is configured to be disposed in the ground and support a load. A connection device is positioned around the rod and configured to transmit torque to the piling. The connection device includes threads that are configured to engage the threads of the rod.

In another embodiment, the helical pile assembly includes an upper body and a lower body. The upper body includes a plate and a stem extending from the plate. A bore is defined at least partially through the stem, and an inner surface of the stem defining the bore includes threads. The lower body includes an upper portion and a lower portion. The upper portion includes a shaft having threads formed on an outer surface thereof. The threads on the outer surface of the shaft are configured to engage the threads on the inner surface of the stem. A tubular member is configured to be coupled to the lower portion of the lower body.

A method for assembling a helical pile assembly is also disclosed. The method includes positioning a lock member about a rod. The rod extends from a plate. A connection device is positioned about the rod after the lock member is positioned about the rod. The connection device is inserted at least partially into an adapter. A piling is also inserted at least partially into the adapter.

It is to be understood that both the foregoing general description and the following detailed description are exemplary and explanatory only and are not restrictive of the present teachings, as claimed.

BRIEF DESCRIPTION OF THE DRAWINGS

The accompanying figures, which are incorporated in and constitute a part of this specification, illustrate embodiments of the present teachings and together with the description, serve to explain the principles of the present teachings. In the figures.

Figure 1:
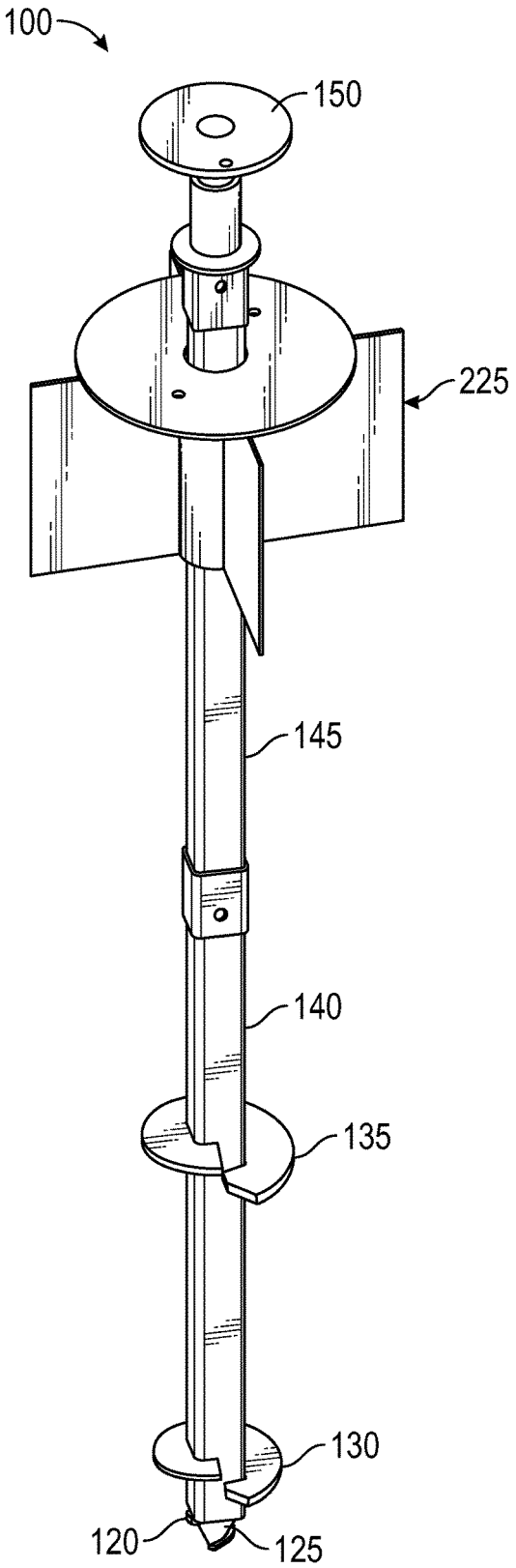
FIG. 1 illustrates a perspective view of a helical pile assembly, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

Figure 2:
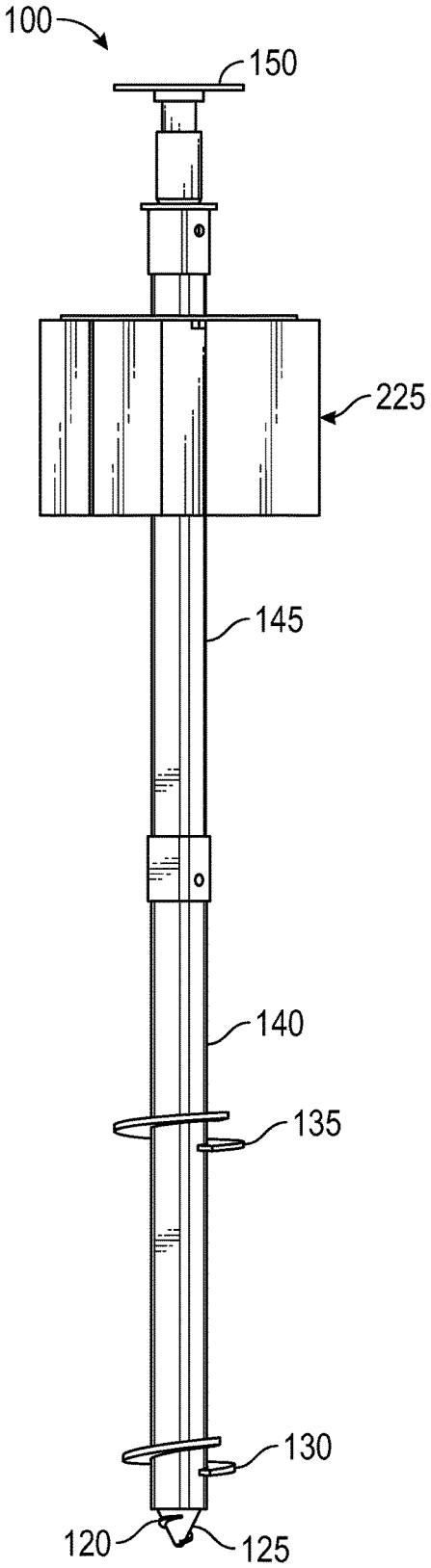
FIG. 2 illustrates a side view of the helical pile assembly, according to an embodiment.

FIG. 1 illustrates a perspective view of a helical pile assembly 100, and FIG. 2 illustrates a side view of the helical pile assembly 100, according to an embodiment. The helical pile assembly 100 may include a nose 125, a lead 140 (e.g., a tubular member), and a top plate (also referred to as a support member) 150. The helical pile assembly 100 may also include an optional lateral support device 225 and an optional extension 145 (e.g., another tubular member). The lead 140 and the extension 145 may have a cross-sectional shape that is circular, polygonal (e.g., rectangular), or the like.

The helical pile assembly 100 may be configured to be advanced into the ground by a downward force, a rotational force, or a combination thereof. Thereafter, the helical pile assembly 100 may provide support to an external object, such as pipelines, related gas distribution systems, metal safe room, shelter, or other gas and oilfield equipment and structures. The nose 125 may be configured to reduce the resistance and guide the helical pile assembly 100 as the helical pile assembly 100 is pressed or rotated downward into the ground. The top plate 150 may be configured to support the external object. The lateral support device 225 may be configured to provide lateral support after the helical pile assembly 100 is in the ground.

As shown in FIGS. 1 and 2, the nose 125 includes a nose helix 120, and the lead 140 includes a first helix 130 and optionally a second helix 135. Each helix 120, 130, 135 may be configured to aid in the advancement of the helical pile assembly 100 into the ground. Further, the starting points of the helixes 120, 130, 135 may be rotationally aligned. Additionally, the outer diameters of the helixes 120, 130, 135 may increase along the length of the helical pile assembly 100 from the nose 125 toward the top plate 150. Although three separate helixes 120, 125, 135 are shown in FIG. 1, there may be any number of helixes on the helical pile assembly 100 without departing from the principles of the present disclosure.

Figure 3:
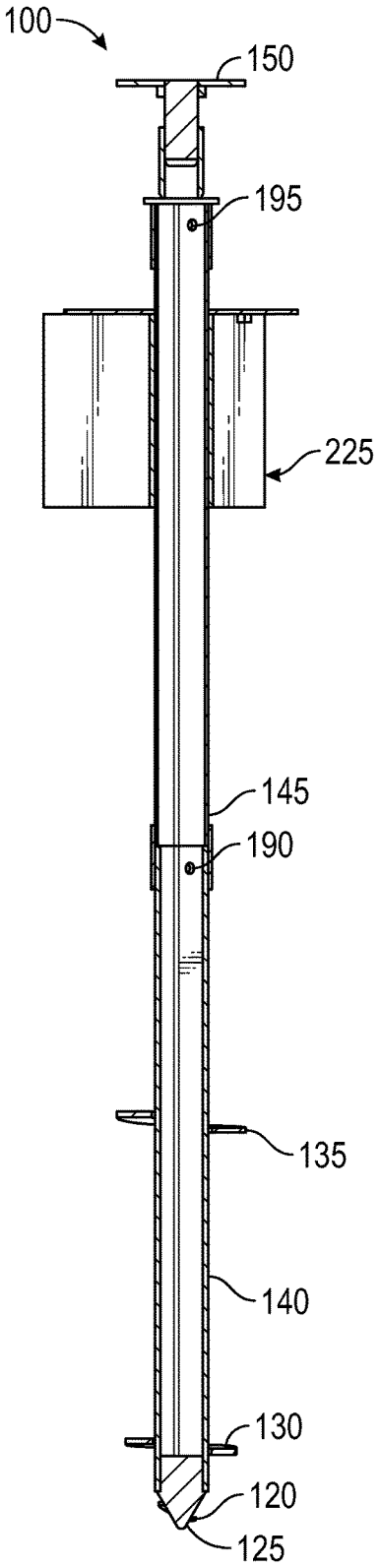
FIG. 3 illustrates a cross-sectional view of the helical pile assembly, according to an embodiment.

FIG. 3 illustrates a cross-sectional view of the helical pile assembly 100, according to an embodiment. As shown, a portion of the nose 125 may be inserted into an end of the lead 140. The nose 125 may be connected to the lead 140 in any suitable manner, such as welding, epoxy, or connection members (e.g., bolts).

The lead 140 and the extension 145 may be connected together using connection members 190, such as bolts. In a similar manner, the top plate 150 may be connected to the extension using connections members 195, such as bolts.

Figure 4:
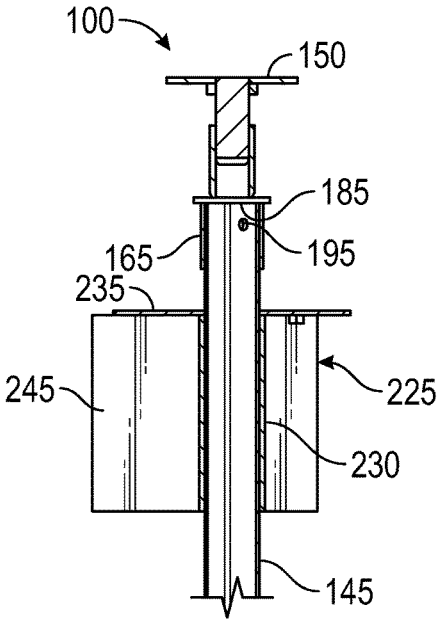
FIG. 4 illustrates an enlarged view of a top plate and a lateral support device of the helical pile assembly, according to an embodiment.

FIG. 4 illustrates an enlarged view of the top plate 150 and the lateral support device 225 of the helical pile assembly 100. As will be discussed herein, the lateral support device 225 may be attached to the extension 145 after the lead 140 and the extension 145 are advanced into the ground. Generally, a base 230 of the lateral support device 225 may be placed around a portion of the extension 145 that is sticking out of the ground. Thereafter, a force may be applied to a plate 235 of the lateral support device 225 which causes blades 245 of the lateral support device 225 to advance the lateral support device 225 toward or into the ground. In the embodiment shown in FIG. 4, the lateral support device 225 may be advanced toward or into the ground independent of the advancement of the lead 140 and the extension 145. In other words, the lead 140 and the extension 145 may be advanced into the ground first and then the lateral support device 225 may be advanced into the ground at a later time.

In an alternative embodiment, the lead 140, the extension 145, and the lateral support device 225 may be advanced into the ground together as a single unit. In this embodiment, a bearing member (not shown) may be placed between the base 230 of the lateral support device 225 and the blades 245 of the lateral support device 225 which allows the base 230 to rotate relative to the blades 245. As such, the blades 245 remain rotationally fixed as the base 230 of the lateral support device 225 is rotated with the lead 140 and the extension 145 during advancement of the helical pile assembly 100 into the ground. In this manner, the lateral support device 225 may be pulled into the ground as the lead 140 and the extension 145 are advanced into the ground.

Figure 5:
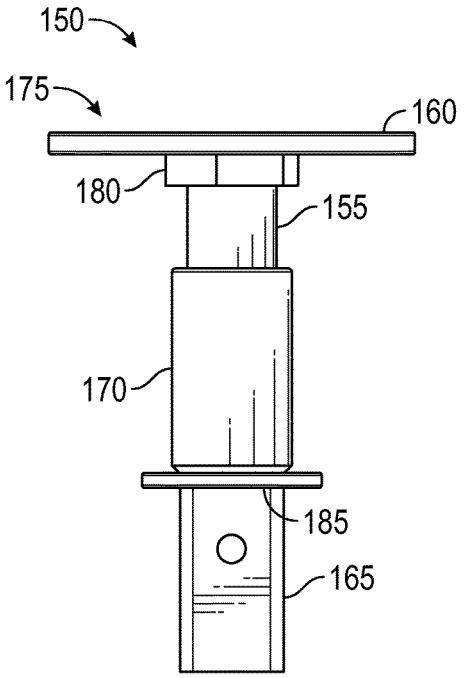
FIG. 5 illustrates a side view of the top plate of the helical pile assembly, according to an embodiment.

FIG. 5 illustrates a side view of the top plate 150 of the helical pile assembly 100, according to an embodiment. The top plate 150 may include a body 170, a coupling 165, and a plate assembly 175. The coupling 165 may be configured to engage the extension 145 (see FIG. 4) of the helical pile assembly 100. The coupling 165 may include a bumper plate 185 that abuts an upper end of the extension 145 (see FIG. 4) when the top plate 150 is attached to the extension 145. The configuration of the bumper plate 185 allows the forces applied to the top plate 150 to be transmitted to through the components of the top plate 150 and into the lead 140 and the extension 145.

The plate assembly 175 may be movable relative to the body 170. The plate assembly 175 may include a plate 160 and a stem 155. The stem 155 may be attached directly to the plate 160 via a nut 180 as shown or via welding, epoxy, or the like. In one embodiment, the stem 155 may be a threaded member that is configured to engage internal threads in the body 170. In this embodiment, the plate assembly 175 may be rotated to move the plate assembly 175 relative to the body 170.

Figure 6:
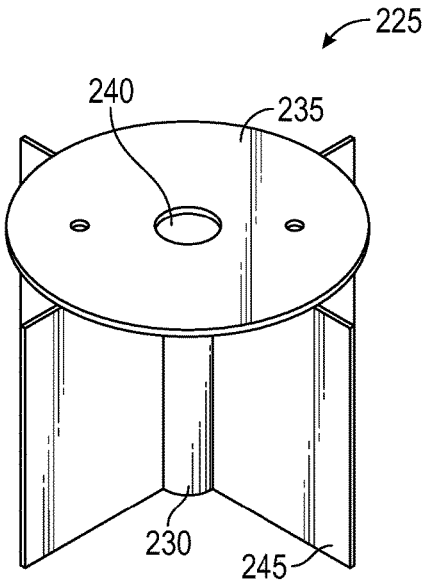
FIG. 6 illustrates a perspective view of a lateral support device of the helical pile assembly, according to an embodiment.

FIG. 6 illustrates a perspective view of the lateral support device 225 of the helical pile assembly 100, according to an embodiment. The lateral support device 225 includes the base 230, the plate 235, and the blades 245. The base 230 may include a bore 240 that is configured to slide over a portion of the extension 145. In one embodiment, a bonding agent may be used to connect the lateral support device 225 to the extension 145. The bonding agent may be placed on the extension 145 and/or in the bore 240 of the base 230. The blades 245 are connected to the base 230 and the plate 235. In one embodiment, the blades 245 may have a taper (or chamfer) at the lower end of each blade 245, such as the outer corner, to reduce the resistance and guide the lateral support device 225 into the ground. In another embodiment, the blades 245 may have a saw tooth arrangement at the lower end of each blade 245 to reduce the resistance and guide the lateral support device 225 into the ground. The lateral support device 225 may be configured to provide lateral support device to the helical pile assembly 100.

Figure 7:
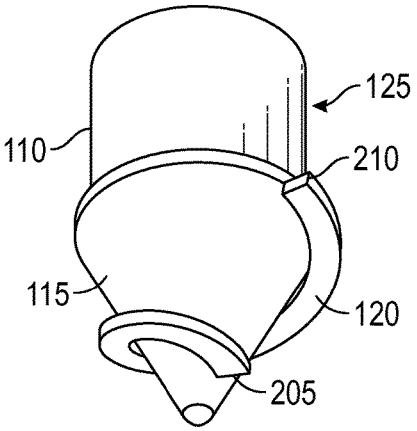
FIG. 7 illustrates a perspective view of a nose of the helical pile assembly, according to an embodiment.
Figure 8:
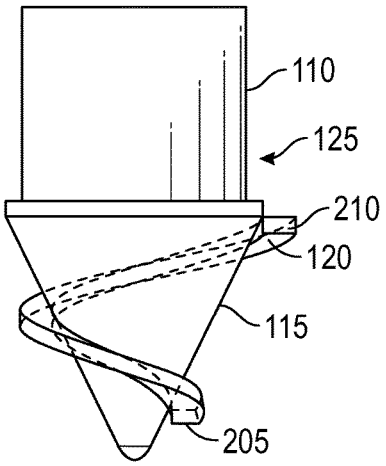
FIG. 8 illustrates a side view of the nose of the helical pile assembly, according to an embodiment.

FIG. 7 illustrates a perspective view of the nose 125 of the helical pile assembly 100, and FIG. 8 illustrates a side view of the nose 125 of the helical pile assembly 100, according to an embodiment. The nose 125 may be disposed at the end of the lead 125. The nose 125 may include a base 110 and a tapered surface 115. The cross-sectional length (e.g., diameter) of the tapered surface 115 may increase moving away from the tip of the nose 125. For example, the tapered surface 115 may be conical or frustoconical. As such, the tapered surface 115 may define an inclination angle. The inclination angle may be characterized as being defined between the tapered surface 115 and a longitudinal centerline through the base 110. The inclination angle may be from about 15 degrees, about 20 degrees, or about 25 degrees to about 35 degrees, about 40 degrees, or about 45 degrees, with respect to the longitudinal centerline of the base 110. This shape may facilitate the nose 125 being used to drill into the ground beneath the lead 125 when the helical pile assembly 100 is advanced into the ground. The nose 125 may be configured to reduce the resistance and guide the helical pile assembly 100 as a downward force pushes the helical pile assembly 100 into the ground.

The nose 125 may also include the helix 120, as shown. In one embodiment, the helix 120 may be a metal bar that is welded to the tapered surface 115. In another embodiment, the nose 125 may be a molded object, and the helix 120 may be molded to the tapered surface 115. The helix 120 may have a start point 205 and an end point 210. The start point 205 of the helix 120 may be aligned with the start point of the helixes 130, 135 on the lead 125. The nose 125 may be made from a metallic material, such as steel. Additionally, the nose 125 and the helix 120 may be made using a forging process, a casting process, a machining process, or a combination thereof.

Figure 9:
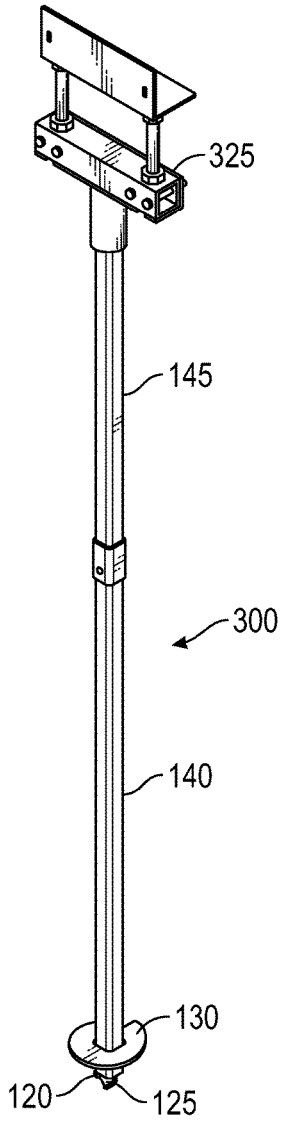
FIG. 9 illustrates a perspective view of another helical pile assembly, according to an embodiment.
Figure 10:
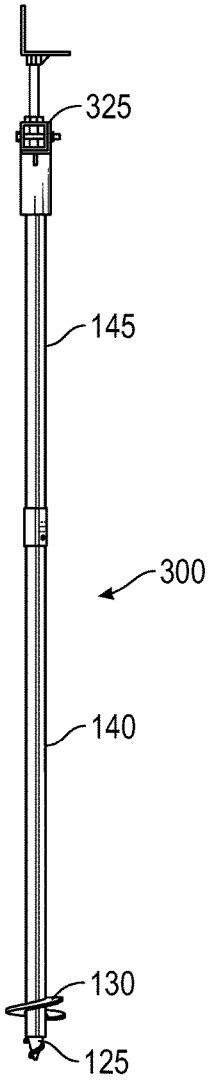
FIG. 10 illustrates a side view of the helical pile assembly shown in FIG. 9, according to an embodiment.
Figure 11:
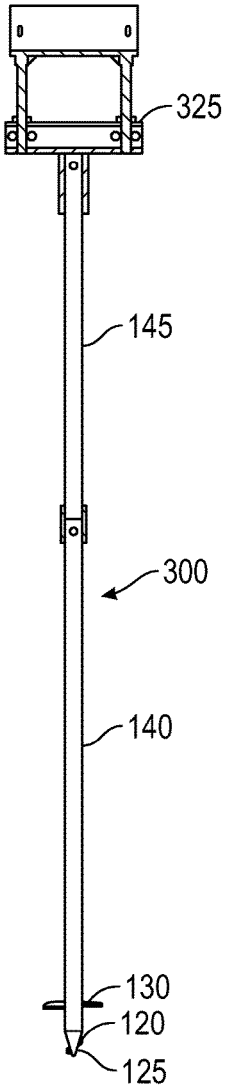
FIG. 11 illustrates a cross-sectional view of the helical pile assembly shown in FIG. 9, according to an embodiment.

FIGS. 9-11 illustrate views of another helical pile assembly 300, according to an embodiment. For convenience, the components in the helical pile assembly 300 that are similar to the components in the helical pile assembly 100 are labeled with the same reference characters.

The helical pile assembly 300 may include the nose 125 and the lead 140. The helical pile assembly 300 may also include an underpinning device 325. The helical pile assembly 300 may also include an optional lateral support device (not shown) and the optional extension 145. The nose 125 may be configured to reduce the resistance and guide the helical pile assembly 300 into the ground. The lateral support device (not shown) may be used to provide lateral support after the helical pile assembly 300 is in the ground.

The helical pile assembly 300 may be configured to be advanced into the ground in a similar manner as discussed above. Thereafter, the helical pile assembly 300 may be used to provide support to an external object, such as a concrete or steel structure used in the oil and gas industry. The underpinning device 325 may be configured to support the external object.

Figure 12:
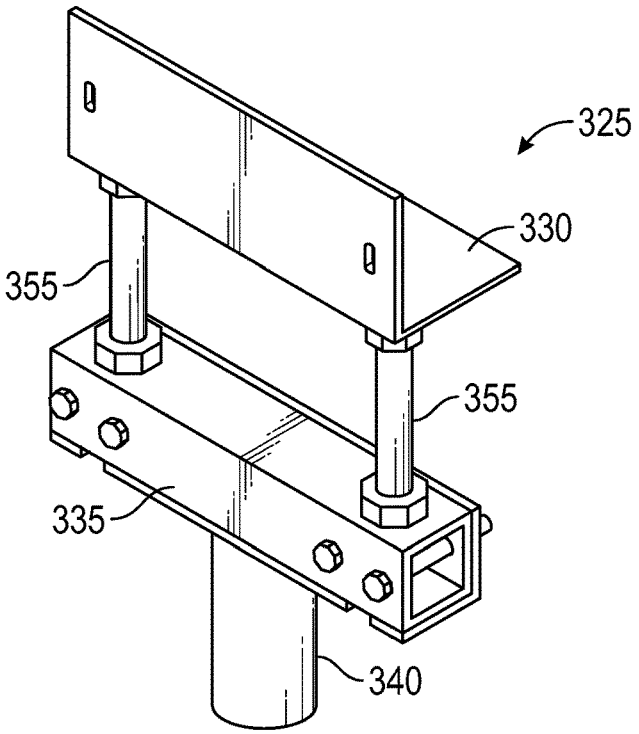
FIG. 12 illustrates a perspective view of an underpinning device of the helical pile assembly shown in FIG. 9, according to an embodiment.

FIG. 12 illustrates a perspective view of the underpinning device 325 of the helical pile assembly 300, according to an embodiment. As shown, the underpinning device 325 may include a support 330 that is connected to a base 335 via one or more rods 355. Additionally, the underpinning device 325 may include a coupling member 340 that is configured to couple the underpinning device 325 to the extension 145.

Figure 13:
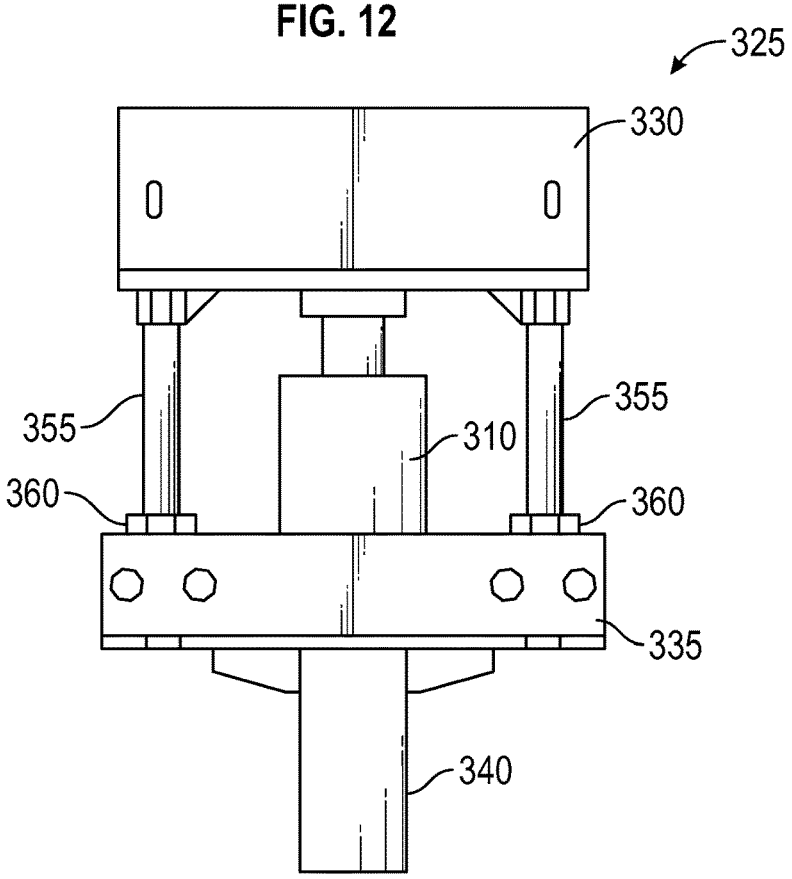
FIG. 13 illustrates a front view of the underpinning device of the helical pile assembly shown in FIG. 9, according to an embodiment.
Figure 14:
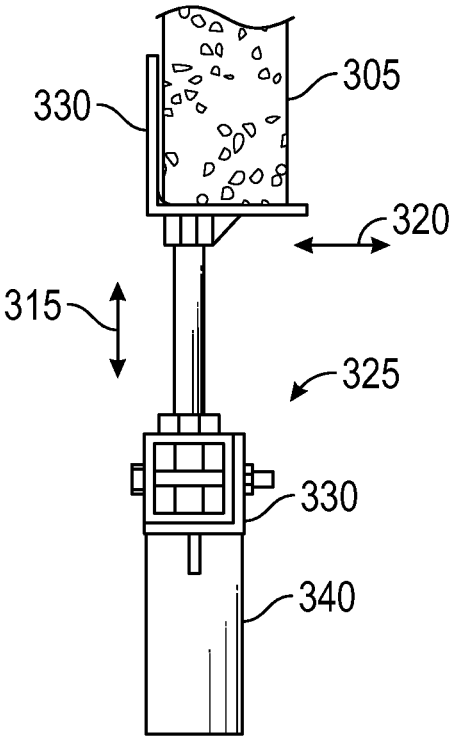
FIG. 14 illustrates a side view of the underpinning device of the helical pile assembly shown in FIG. 9, according to an embodiment.
Figure 15:
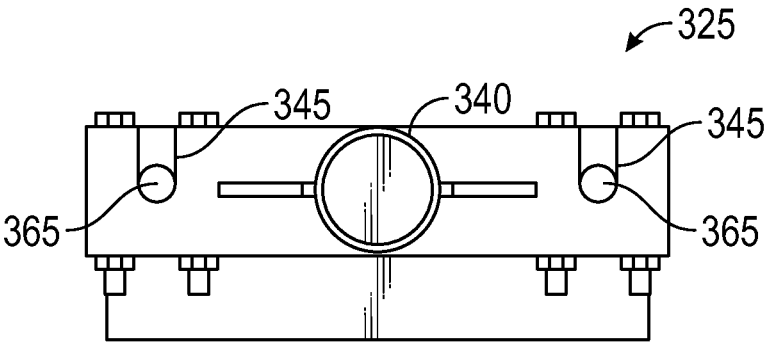
FIG. 15 illustrates a bottom view of the underpinning device of the helical pile assembly shown in FIG. 9, according to an embodiment.

FIG. 13 illustrates a front view of the underpinning device 325 of the helical pile assembly 300. FIG. 14 illustrates a side view of the underpinning device 325. FIG. 15 illustrates a bottom view of the underpinning device 325. After the helical pile assembly 300 is inserted into the ground (and the optional lateral support device is attached), the support 330 may be moved in a vertical direction 315 and/or a horizontal direction 320 relative to the base 335 to allow the support 330 to be positioned adjacent to an external object 305 (shown in FIG. 14). For instance, the plate 330 may be moved in the horizontal direction 320 by adjusting pins 365 in slots 345 (FIG. 15) such that the plate 330 is adjacent to the external object 305 in the horizontal position. Then, the pins 365 may be secured in the location in the slots 345. The plate 330 may be moved in the vertical direction 315 by using a jack 310 (FIG. 13) that is placed between the plate 330 and the base 335. In operation, the jack 310 may be activated to move the plate 330 relative to the base 335 to a vertical position adjacent the external object 305. After the plate 330 is in a proper location, nuts 360 may be moved along the rods 355 (e.g., threaded rod) to a position adjacent the base 335 as shown in FIG. 14. Thereafter, the jack 310 may be deactivated and removed from the underpinning device 325.

Figure 16:
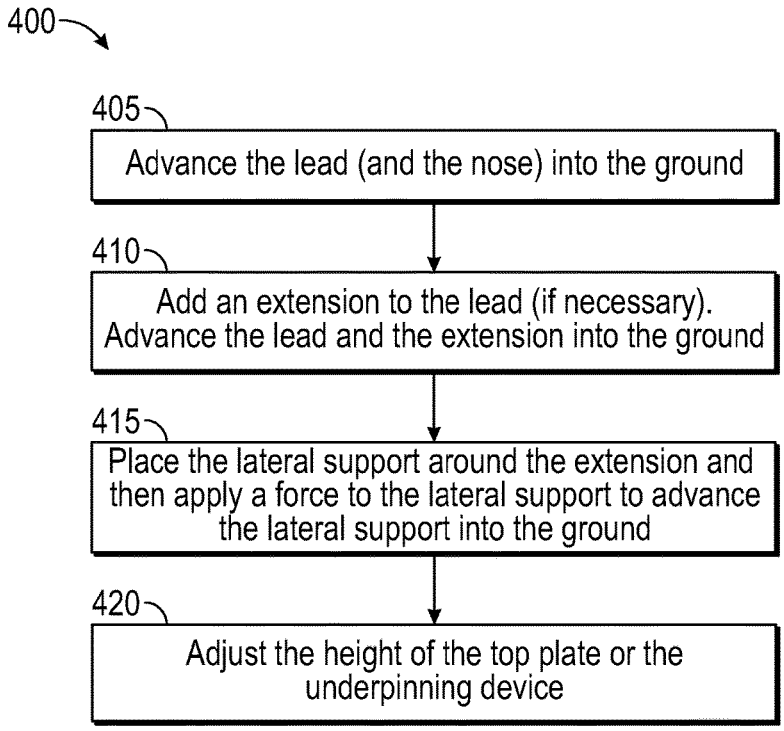
FIG. 16 illustrates a flowchart of a method for using the helical pile assembly, according to an embodiment.

FIG. 16 illustrates a flowchart of a method 400 for using the helical pile assembly, according to an embodiment. The method 400 may be employed using one or more embodiments of the helical pile assembly discussed above. However, in other embodiments, the method 400 may be employed to use other helical pile assemblies, and thus may not be limited to any particular structure. The method 400 may begin by advancing the lead 140 with nose 125 into the ground, as at 405. The method may also include adding an extension 145 to the lead 140 if additional depth is necessary for the helical pile assembly, at 410. The lead 140 and the extension 145 may be advanced further into the ground until a predetermined torque value is reached. The method 400 may also include placing the lateral support device 225 around the extension 145, at 415. The lateral support device 225 may be advanced into the ground by applying a vertical/compressive force to the lateral support device 225. The method 400 may further include adjusting the height of top plate 150 (helical pile assembly 100) or the height of the underpinning device 325 (helical pile assembly 300), at 420. Additionally, the horizontal direction of the underpinning device 325 may also be adjusted.

Figure 17:
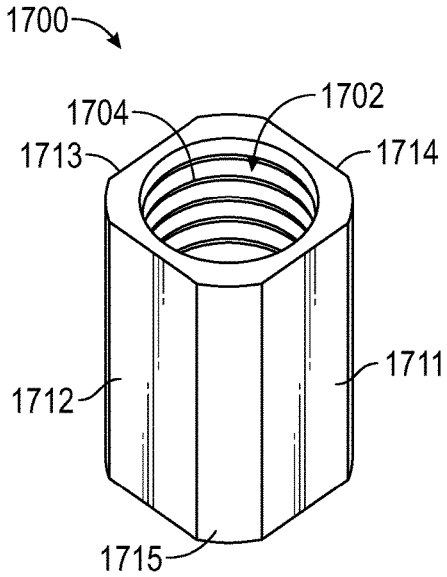
FIG. 17 illustrates a perspective view of a first nut, according to an embodiment.

FIG. 17 illustrates a perspective view of a connection device 1700, according to an embodiment. In at least one embodiment, the connection device 1700 may be a nut. The connection device 1700 may include an axial bore 1702 formed at least partially therethrough. An inner surface of the connection device 1700 that defines the bore 1702 may include threads 1704. An outer surface of the connection device 1700 may have a cross-sectional shape that is circular, polygonal (e.g., square), or a combination thereof. As shown, the outer surface of the connection device 1700 has four substantially planar sides 1711-1714. In this embodiment, each side (e.g., side 1711) is perpendicular to the two adjacent sides (e.g., sides 1712, 1714), and each side (e.g., side 1711) is parallel to the opposing side (e.g., side 1713). As shown, the transition 1715 between two adjacent sides (e.g., sides 1711, 1712) may be curved or rounded; however, in other embodiment, the transition 1517 may be a sharp angle (e.g., 90 degrees).

Figure 18:
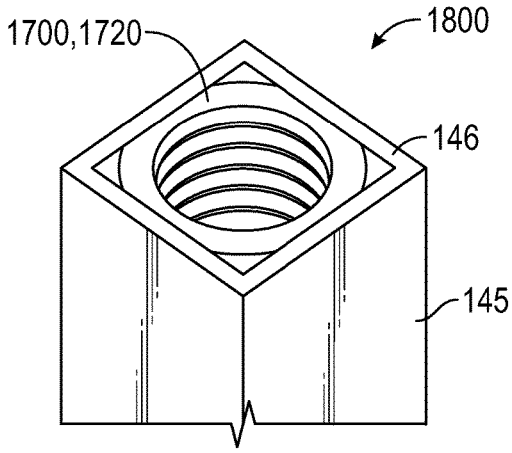
FIG. 18 illustrates a perspective view of a portion of a helical pile assembly showing the first nut positioned at least partially within the extension, according to an embodiment.

FIG. 18 illustrates a perspective view of a portion of a helical pile assembly 1800 showing the connection device 1700 positioned at least partially within the extension 145, according to an embodiment. As shown, the connection device 1700 may be inserted at least partially into an upper end of the extension 145. Although not shown, in other embodiments, the connection device 1700 may instead be inserted at least partially into an upper end of the lead 140.

In at least one embodiment, the connection device 1700 may be inserted into the extension 145 until the connection device 1700 contacts a shoulder or upset formed on the inner surface of the extension 145, which prevents further movement. In other embodiments, the first nut 1700 may be free to move to any position within the extension 145. Once inserted into the extension 145, the connection device 1700 may be welded or mechanically fastened into position within the extension 145. As shown, an upper surface 1720 of the connection device 1700 may be substantially aligned with an upper surface 146 of the extension 145.

When the extension 145 has a polygonal (e.g., square) cross-sectional shape, the sides 1711-1714 of the outer surface of the connection device 1700 may be aligned with the corresponding sides of the inner surface of the extension 145. In at least one embodiment, a small clearance (e.g., less than or equal to about 5 mm) may be present between at least one of the sides 1711-1714 of the outer surface of the connection device 1700 and the corresponding side(s) of the inner surface of the extension 145; however, in other embodiment, the connection device 1700 may form a friction fit with the extension 145 (i.e., no clearance is present). The addition of the connection device 1700 may allow greater torque to be transmitted to the extension 145 than conventional tools that do not include the connection device 1700.

Figure 19:
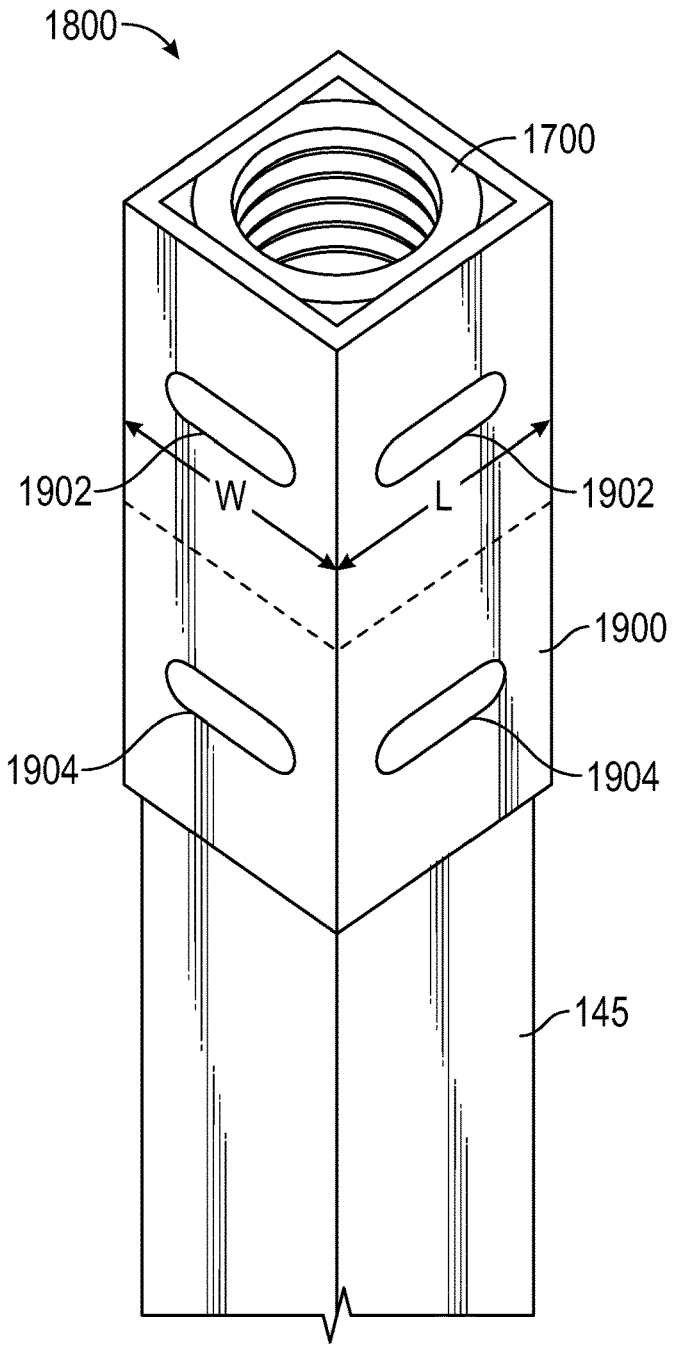
FIG. 19 illustrates a perspective view of a portion of the helical pile assembly of FIG. 18 showing an adapter positioned at least partially around the extension, according to an embodiment.

FIG. 19 illustrates a perspective view of a portion of the helical pile assembly 1800 showing an adapter 1900 positioned at least partially around the extension 145, according to an embodiment. The adapter 1900 may be a hollow tubular member with a cross-sectional shape similar to that of the extension 145. For example, as shown, the adapter 1900 may have a polygonal (e.g., square) cross-sectional shape. The extension 145 may have smaller cross-sectional length L and width W dimensions than the adapter 1900, and the upper end of the extension 145 may be inserted at least partially into the adapter 1900. In one example, the extension 145 may have a cross-sectional length of about 3 inches, and the adapter 1900 may have a cross-sectional length of about 4 inches. The adapter 1900 may transmit torque received by the connection device 1700 to the extension 145.

The adapter 1900 may have one or more openings (four are shown: 1902, 1904) formed laterally therethrough. The openings 1902 may facilitate coupling the adapter 1900 to the connection device 1700. For example, the adapter 1900 may be welded to the connection device 1700 through the openings 1902. The openings 1904 may facilitate coupling the adapter 1900 to the extension 145. For example, the adapter 1900 may be welded to the extension 145 through the openings 1904. In another example, the extension 145 may also include one or more openings (not shown) formed laterally therethrough. The openings in the extension 145 may be aligned with the openings 1904 in the adapter 1900, and a connection member, such as a bolt, may be inserted through the openings 1904 in the adapter 1900 and the openings in the extension 145. The coupling of the adapter 1900 and the extension 145 may prevent relative axial movement and relative rotational movement with respect to one another.

Figure 20:
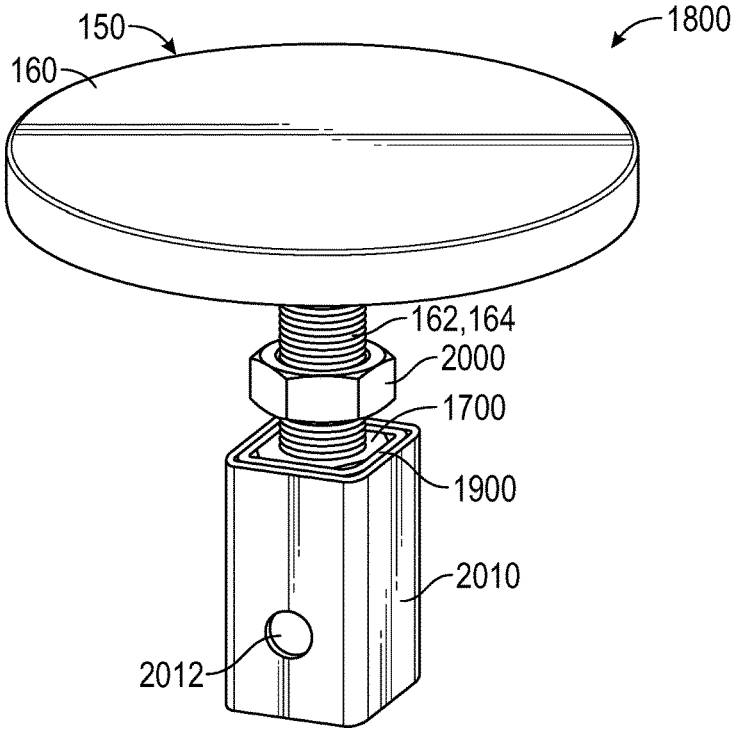
FIG. 20 illustrates a perspective view of the helical pile assembly of FIG. 18 showing a lock member positioned between the top plate on one side and the first nut, the adapter, and a coupling on the other side, according to an embodiment.

FIG. 20 illustrates a perspective view of the helical pile assembly 1800 showing a lock member 2000 positioned between the top plate 150 on one side and the connection device 1700, the adapter 1900, and a coupling 2010 on an opposing side, according to an embodiment. The top plate 150 may include a rod 162 that extends downward from the plate 160. As shown, the rod 162 may be inserted at least partially into the connection device 1700. The rod 162 may include threads 164 that engage the threads 1704 of the connection device 1700.

The lock member 2000 may be positioned around the rod 162. Rotation of the lock member 2000 about the rod 162 may cause the lock member 2000 to move axially along the rod 162. For example, rotation in a first direction may cause the lock member 2000 to move toward the plate 160, and rotation in a second, opposing direction may cause the lock member 2000 to move toward the connection device 1700 and/or the adapter 1900.

When the lock member 2000 is spaced apart from the connection device 1700 and/or the adapter 1900, as shown in FIG. 20, the top plate 150 (including the plate 160 and the rod 162) may be rotated with respect to the connection device 1700 and the adapter 1900. For example, a user may rotate the plate 160 in a first direction that may cause the top plate 150 (and lock member 2000) to move toward the connection device 1700 and the adapter 1900. The user may also or instead rotate the plate 160 in a second, opposing direction that may cause the top plate 150 (and lock member 2000) to move away from the connection device 1700 and adapter 1900.

As shown, the coupling 2010 may be positioned at least partially around the adapter 1900. The coupling 2010 may include one or more openings (one is shown: 2012) formed laterally therethrough. In one embodiment, the coupling 2010 may be welded to the adapter 1900 and/or the extension 145 through the opening 2012. In another embodiment, the adapter 1900 and/or the extension 145 may include an opening formed laterally therethrough, and when the opening 2012 in the coupling 2010 is aligned with the opening in the adapter 1900 and/or the extension 145, a bolt may be inserted therethrough to couple the components together.

Figure 21:
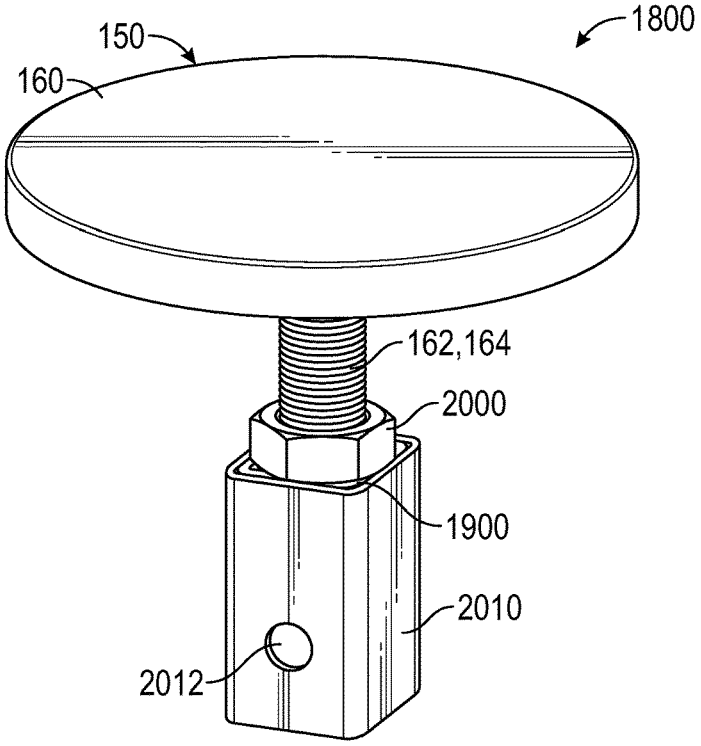
FIG. 21 illustrates a perspective view of the helical pile assembly of FIG. 18 showing the lock member abutting the first nut, the adapter, and/or the coupling, according to an embodiment.

FIG. 21 illustrates a perspective view of the helical pile assembly 1800 of FIG. 20 showing the lock member 2000 abutting the connection device 1700, the adapter 1900, and/or the coupling 2010, according to an embodiment. Rotation of the lock member 2000 with respect to the rod 162 of the top plate 150, and/or rotation of the top plate 150 with respect to the connection device 1700, may cause the lock member 2000 to come into contact with the connection device 1700, the adapter 1900, and/or the coupling 2010, as shown in FIG. 21. When the lock member 2000 contacts the connection device 1700, the adapter 1900, and/or the coupling 2010, the top plate 150 is prevented from moving further toward the connection device 1700, the adapter 1900, and/or the coupling 2010. The weight of the top plate 150 (plus any object that it supports) may prevent the top plate 150 from moving in the opposing direction (i.e., away from the connection device 1700, the adapter 1900, and/or the coupling 2010), and/or the top plate 150 may be secured to the rod 162, e.g., via welding, integral formation, fasteners (such as with a bracket) or the like. Thus, the top plate 150 may effectively be secured in place when the lock member 2000 abuts the connection device 1700, the adapter 1900, and/or the coupling 2010. As shown in FIG. 21, the lock member 2000 is illustrated as a nut.

Figure 22A:
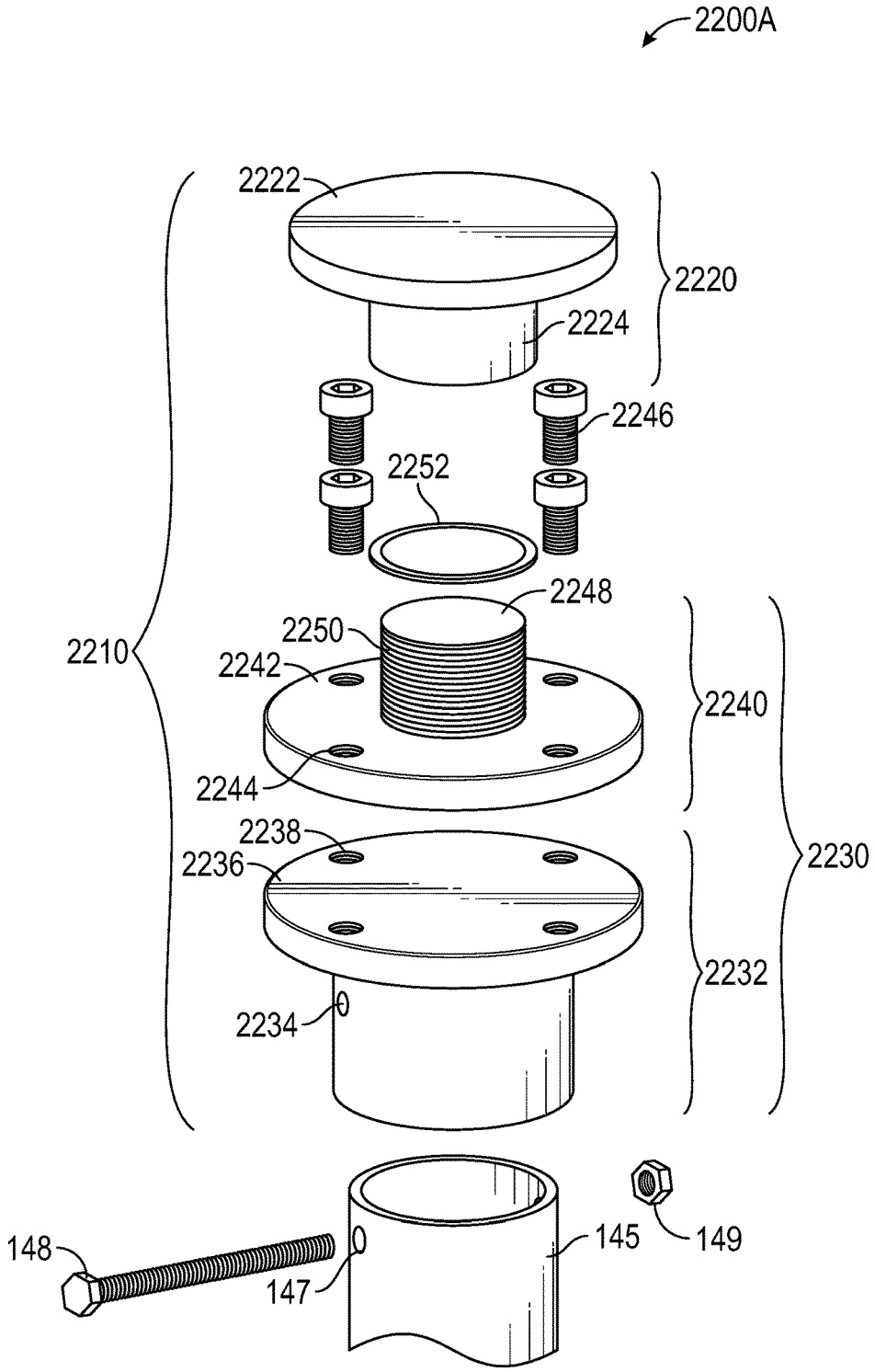
FIG. 22A illustrates an exploded perspective view of a helical pile assembly including an extension having a substantially circular cross-sectional shape, according to an embodiment.

FIG. 22A illustrates an exploded perspective view of another helical pile assembly 2200A showing the extension 145 having a substantially circular cross-sectional shape, according to an embodiment. The helical pile assembly 2200A may include a top plate 2210 having an upper body 2220 and a lower body 2230. The lower body 2230 may include a lower portion 2232 and an upper portion 2240.

The lower portion 2232 of the lower body 2230 may have a cross-sectional shape that is similar to that of the extension 145. Thus, as shown, the lower portion 2232 may have a substantially circular cross-sectional shape. In at least one embodiment, the dimensions of an inner surface of the lower portion 2232 of the lower body 2230 may be greater than or equal to the dimensions of an outer surface of the extension 145 such that the extension 145 may be inserted at least partially into the lower portion 2232. In another embodiment, the dimensions of an inner surface of the extension 145 may be greater than or equal to the dimensions of an outer surface of the lower portion 2232 such that the lower portion 2232 may be inserted at least partially into the extension 145.

The extension 145 may have one or more openings 147 formed laterally (e.g., radially) therethrough. For example, the extension 145 may have two openings 147 that are offset by 180 degrees from one another. The lower portion 2232 of the lower body 2230 may also have one or more openings 2234 formed laterally (e.g., radially) therethrough. For example, the openings 2234 may be offset by 180 degrees from one another. In another example, the extension 145 may have two or more openings 147 parallel to a longitudinal axis of the extension 145.

When the extension 145 is inserted into the lower portion 2232 of the lower body 2230 (or vice versa), the openings 147 in the extension 145 may be aligned with the openings 2234 in the lower portion 2232 of the lower body 2230. One or more connection members 148, such as a through-bolt, may then be inserted through aligned openings 147, 2234 to secure the extension 145 to the lower portion 2232 of the lower body 2330. When the connection member 148 is a through-bolt, a nut 149 may be threaded onto an end of the through-bolt after the through-bolt extends all the way through the extension 145 and the lower portion 2232 of the lower body 2230 to secure the components 145, 2232 together.

The lower portion 2232 of the lower body 2230 may include an upper plate 2236 having one or more openings 2238 formed therethrough. The openings 2238 in the upper plate 2236 may be substantially parallel to the central longitudinal axis through the lower body 2230 and substantially perpendicular to the lateral openings 2234. The upper portion 2240 of the lower body 2230 may include a lower plate 2242 having one or more openings 2244 formed therethrough. The openings 2244 in the lower plate 2242 may be substantially parallel to the central longitudinal axis through the lower body 2230. As such, when the upper plate 2236 contacts the lower plate 2242, the openings 2238, 2244 may be substantially aligned. Connection members 2246, such as screws (e.g., Alice screws) or bolts, may then be inserted the aligned openings 2238, 2244 to secure the portions 2232, 2240 of the lower body 2230 together.

The upper portion 2240 of the lower body 2230 may include a shaft 2248 extending axially (e.g., upward) from the lower plate 2242. The shaft 2248 may have an outer surface with threads 2250 formed thereon. In at least one embodiment, a ring (e.g., a C-ring or lock ring) 2252 may be positioned at least partially around the shaft 2248.

The stem 2224 of the top plate 2210 may extend downward from the plate 2222. The stem 2224 may have threads formed on the inner surface thereof that are configured to engage the threads 2250 of the shaft 2248. Once the threads of the stem 2224 are engaged with the threads 2250 of the shaft 2248, and the plate 2222 is set at the predetermined distance relative to the extension 145, the ring 2252 may lock the upper body 2220 relative to the lower body 2230, thereby securing the components together.

Figure 22B:
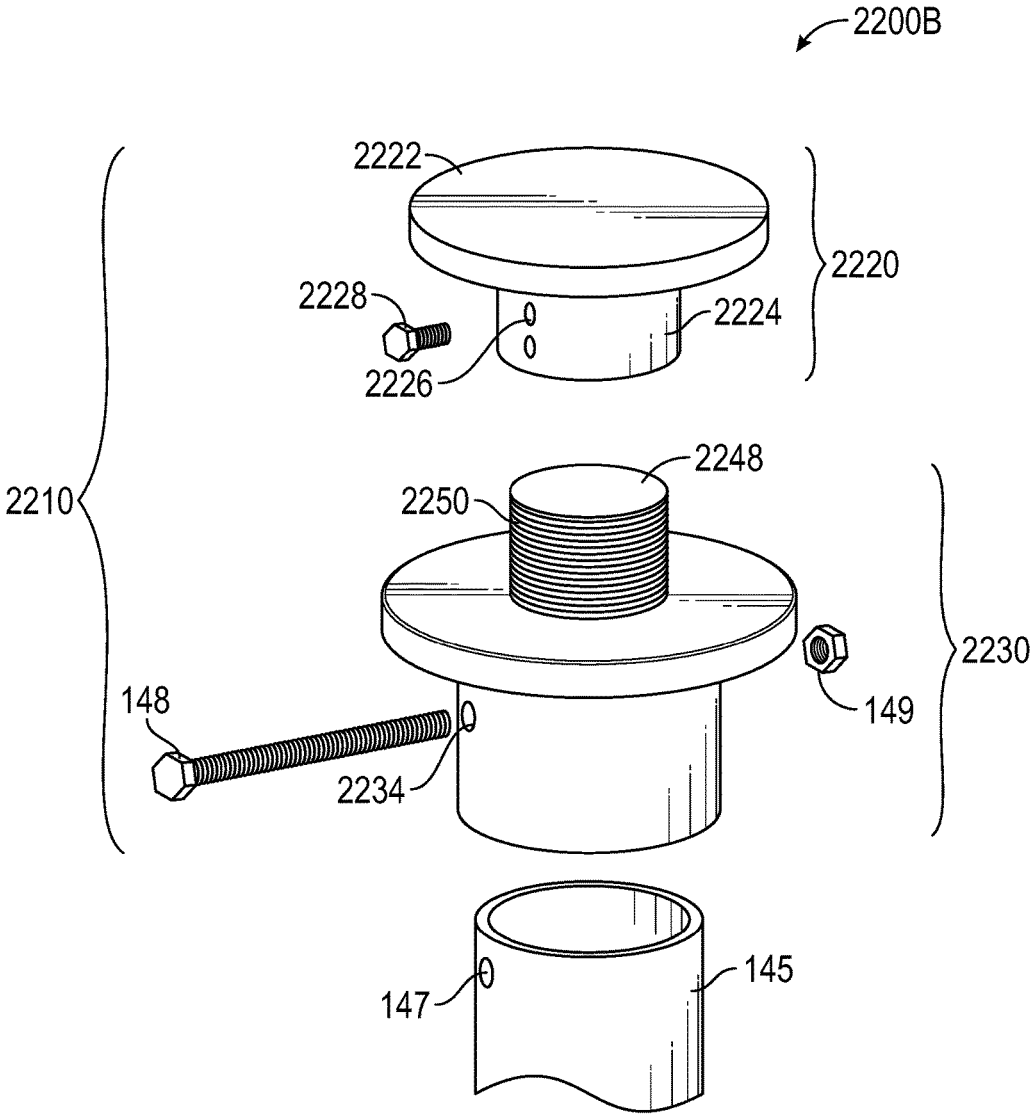
FIG. 22B illustrates another exploded perspective view of the helical pile assembly of FIG. 22A showing the extension having a substantially circular cross-sectional shape, according to an embodiment.

FIG. 22B illustrates another exploded perspective view of the helical pile assembly 2200 showing the extension 145 having a substantially circular cross-sectional shape, according to an embodiment. The stem 2224 may include one or more openings 2226 formed laterally (e.g., radially) therethrough. When the shaft 2248 is inserted into the bore in the stem 2224, one or more connection members 2228, such as screws (e.g., Alice screws) or bolts, may then be inserted the aligned openings 2226 to secure the shaft 2248 to the stem 2224. In addition, the lower body 2230 may be one integral component, rather than two separate portions 2232, 2240, as shown in FIG. 22A. For example, plate 2242 may be removed, and the shaft 2250 may be coupled to or integral with the plate 2236. The openings 2238, 2244 may also be removed.

Figure 23:
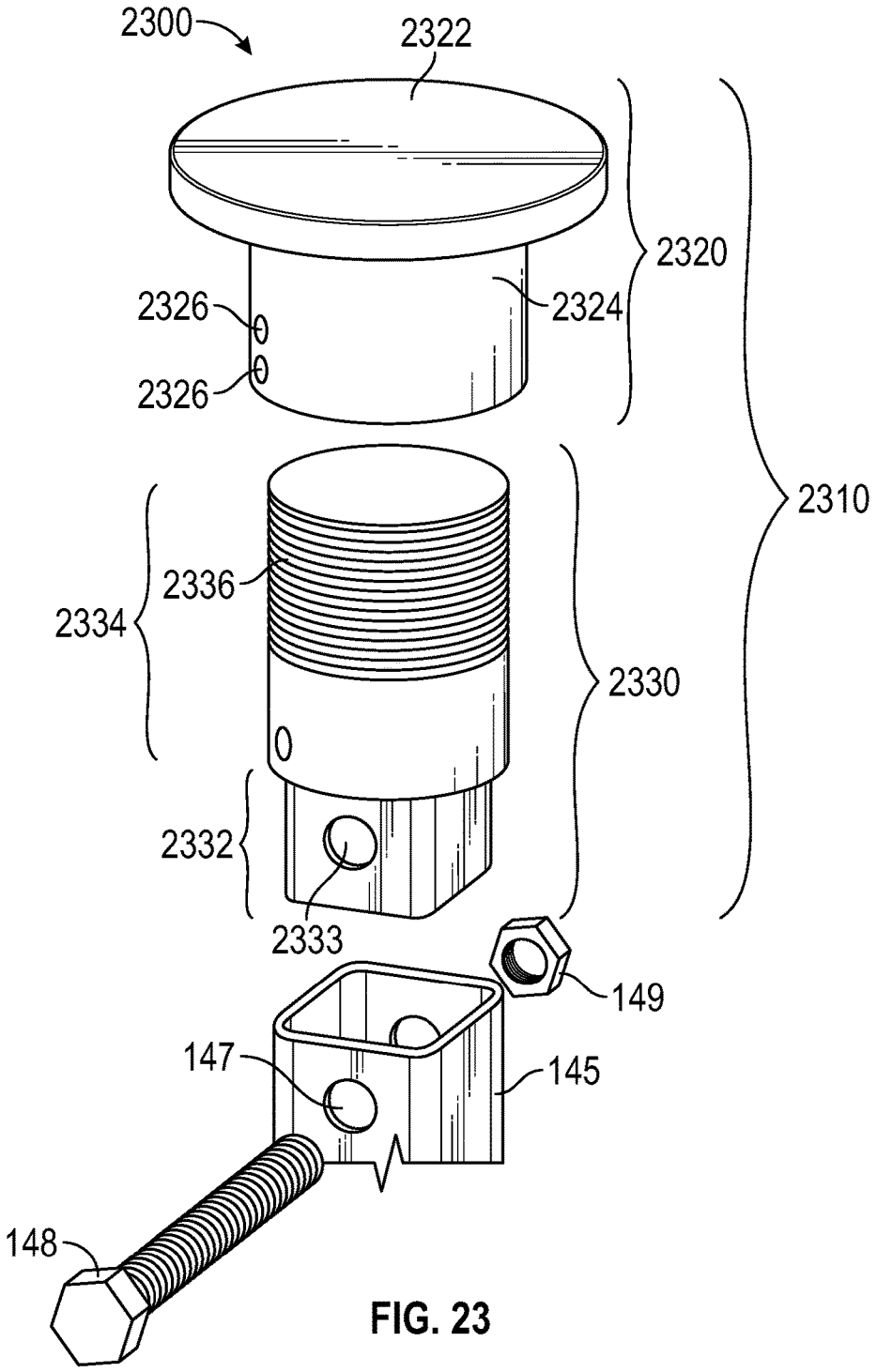
FIG. 23 illustrates an exploded perspective view of another helical pile assembly including an extension having a substantially rectangular (e.g., square) cross-sectional shape, according to an embodiment.

FIG. 23 illustrates an exploded perspective view of another helical pile assembly 2300 showing the extension 145 having a substantially rectangular (e.g., square) cross-sectional shape, according to an embodiment. Although the lower body 2230 in FIG. 22A is shown as two separate pieces, in other embodiments, the lower body 2330 may be one integral piece, as shown in FIG. 23.

The helical pile assembly 2300 may include a top plate 2310 that includes an upper body 2320 and a lower body 2330. A first, lower portion 2332 of the lower body 2330 may have a cross-sectional shape that is similar to that of the extension 145. Thus, as shown, the lower portion 2332 may have a substantially rectangular (e.g., square) cross-sectional shape. In at least one embodiment, the dimensions of the inner surface of the extension 145 may be greater than or equal to the dimensions of an outer surface of the lower portion 2332 of the lower body 2330 such that the lower portion 2332 of the lower body 2330 may be inserted at least partially into the extension 145. In another embodiment, the dimensions of an inner surface of the lower portion 2332 of the lower body 2330 may be greater than or equal to the dimensions of the outer surface of the extension 145 such that the extension 145 may be inserted at least partially into the lower portion 2332 of the lower body 2330.

The extension 145 may have one or more openings 147 formed laterally therethrough. For example, the extension 145 may have two openings 147 that are aligned (e.g., offset by 180 degrees from one another). The lower portion 2332 of the lower body 2330 may also have one or more openings 2333 formed laterally therethrough. For example, the openings 2333 may be aligned (e.g., offset by 180 degrees from one another). When the lower portion 2332 of the lower body 2330 is inserted into the extension 145 (or vice versa), the openings 147 in the extension 145 may be aligned with the openings 2333 in the lower portion 2332 of the lower body 2330. One or more connection members 148, such as a through-bolt, may then be inserted through aligned openings 147, 2333 to secure the extension 145 to the lower portion 2332 of the lower body 2330. When the connection member 148 is a through-bolt, a nut 149 may be threaded onto an end of the through-bolt after the through-bolt extends all the way through the extension 145 and the lower portion 2332 of the lower body 2330 to secure the components 145, 2332 together.

A second, upper portion 2334 of the lower body 2330 may be coupled to or integral with the lower portion 2332. The upper portion 2234 may have a substantially circular cross-sectional shape, and an outer surface of the upper portion 2334 may have threads 2336 formed thereon.

The upper body 2320 of the top plate 2310 may include a plate 2322 and a stem 2324. The stem 2324 may extend downward from the plate 2322. The stem 2324 may have a bore formed at least partially therethrough in an axial direction, and threads may be formed on the inner surface of the stem 2324 that defines the bore. The threads may be configured to engage the threads 2336 of the upper portion 2334 of the lower body 2330. One or more openings 2326 may be formed laterally (e.g., radially) through the stem 2324. When the threads 2336 on the upper portion 2334 of the lower body 2330 are engaged with the threads on the stem 2324, and the plate 2322 is set at the predetermined distance relative to the extension 145, a connection member, such as a screw (e.g., an Alice screw) or bolt, may be inserted into each of the openings 2326 to secure the connection between the upper and lower bodies 2320, 2330.

Figure 24:
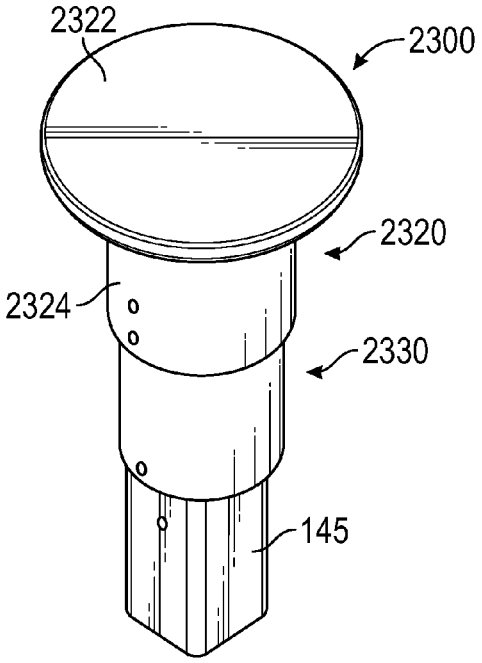
FIG. 24 illustrates a perspective view of the helical pile assembly shown in FIG. 23 with the components coupled together, according to an embodiment.
Figure 25:
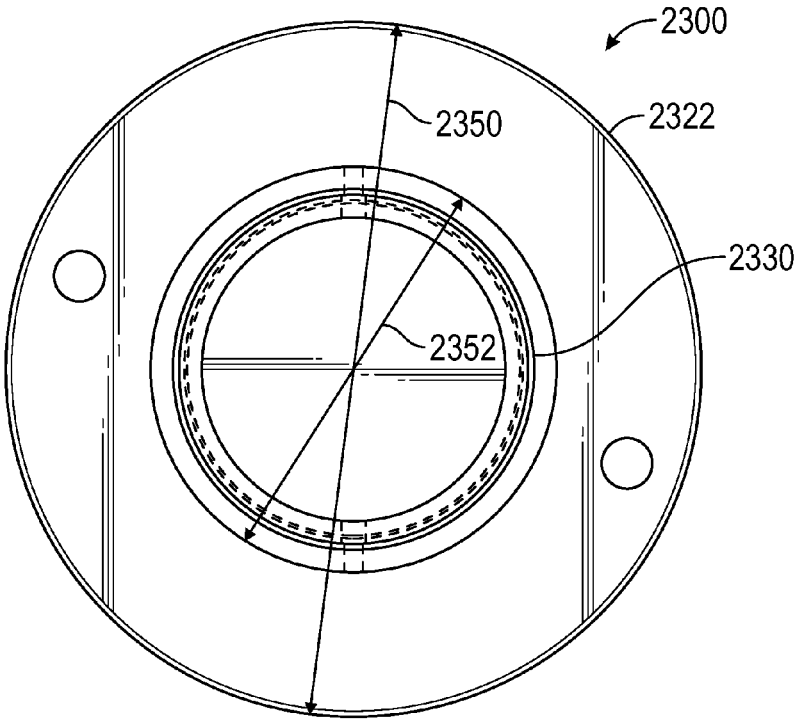
FIG. 25 illustrates a bottom view of the helical pile assembly shown in FIG. 24, according to an embodiment.

FIG. 24 illustrates a perspective view of the helical pile assembly 2300 shown in FIG. 23 with the components coupled together, and FIG. 25 illustrates a bottom view of the helical pile assembly 2300 with the extension 145 omitted, according to an embodiment. In one embodiment, a cross-sectional length (e.g., diameter) 2350 of the plate 2322 may be about 12 inches, and a cross-sectional length (e.g., diameter) 2352 of the stem 2324 may be about 7 inches. This may leave an "overhang" of about 2.5 inches around the circumference of the stem 2324. Thus, in at least one embodiment, a ratio of the cross-sectional length (e.g., diameter) 2352 of the stem 2324 to the cross-sectional length (e.g., diameter) 2350 of the plate 2322 may range from about 1:1 to about 1:2, about 1:1.25 to about 1:2, about 1:1.5 to about 1:2, or about 1:1.75 to about 1:2.

Figure 26:
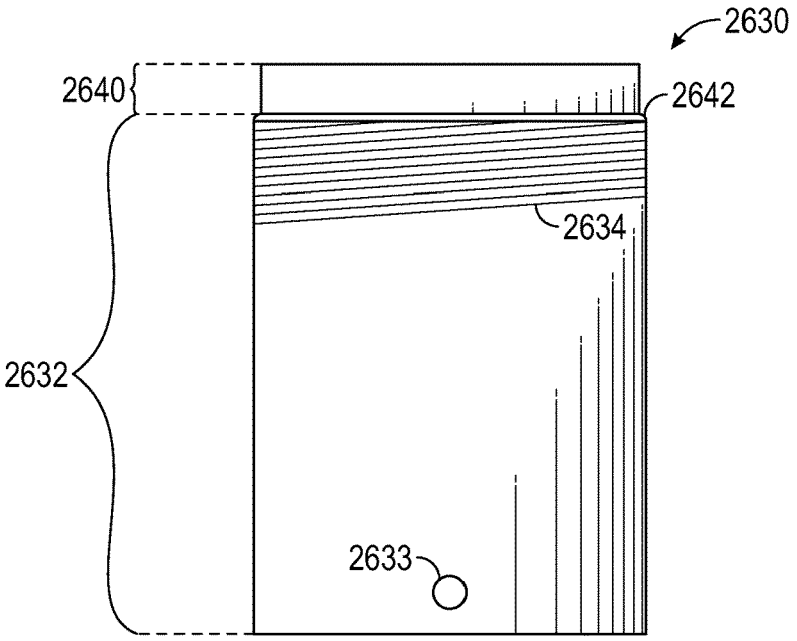
FIG. 26 illustrates a side view of another lower body that may be part of the top plate shown in FIG. 24, according to an embodiment.

FIG. 26 illustrates a side view of another lower body 2630 that may be part of the top plate 2310, according to an embodiment. A first, lower portion 2632 of the lower body 2630 may include one or more openings (one is shown: 2633) formed laterally therethrough. The lower portion 2632 of the lower body 2630 may also include threads 2634 formed on an outer surface thereof. As shown, a second, upper portion 2640 of the lower body 2630 may have a smaller cross-sectional length (e.g., diameter) than the lower portion 2632 of the lower body 2630. The transition 2642 between the lower and upper portions 2632, 2640 may be at an angle from about 20 degrees to about 70 degrees or from about 30 degrees to about 60 degrees with respect to a central longitudinal axis through the lower body 2630.

Figure 27:
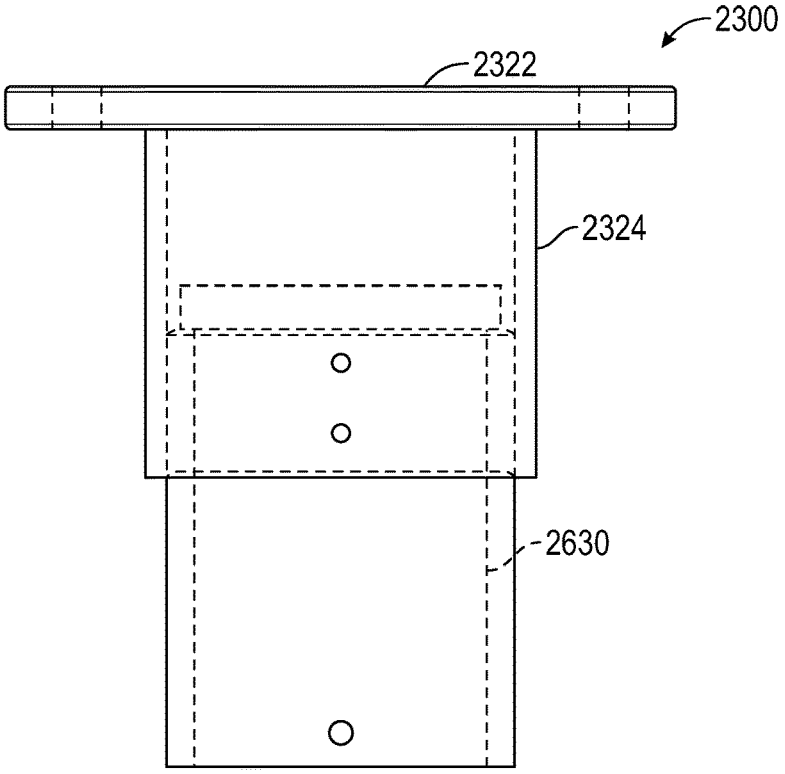
FIG. 27 illustrates a cross-sectional side view of the helical pile assembly shown in FIG. 24 including the lower body shown in FIG. 26, according to an embodiment.

FIG. 27 illustrates a cross-sectional side view of the helical pile assembly 2300 showing the lower body 2630 (from FIG. 26) engaged with the upper body 2320 (from FIGS. 23 and 24), according to an embodiment. The threads 2634 on the lower body 2630 may be configured to engage corresponding threads on the inner surface of the upper body 2320 of the top plate 2310 (see FIGS. 23, 24) to secure the upper and lower bodies 2320, 2630 together.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A helical pile assembly, comprising:

a plate;

a rod extending from the plate, wherein the rod comprises threads;

a piling configured to be disposed in a ground and support a load;

a nose coupled to an end of the piling;

a helix coupled to the nose and extending outward therefrom;

a connection device positioned around the rod and configured to transmit torque to the piling, wherein the connection device comprises threads that are configured to engage the threads on the rod;

a lock member received around the rod and movable axially along the rod, with respect to the plate, by rotating the rod with respect to the lock member, wherein the plate is prevented from moving closer to the connection device when the lock member contacts the connection device; and an adapter positioned at least partially around the connection device and the piling, wherein the connection device comprises a plurality of planar outer surfaces that contact inner surfaces of the adapter.

2. The helical pile assembly of claim 1, wherein the piling and the connection device are axially-offset from one another within the adapter.

3. The helical pile assembly of claim 2, further comprising a coupling positioned at least partially around the adapter.

4. The helical pile assembly of claim 1, further comprising a coupler in which the adapter and the piling are at least partially received, the coupler being secured to the adapter and the piling so as to prevent relative rotation between the coupler and the adapter and between the coupler and the piling.

5. The helical pile assembly of claim 1, wherein the helix is a first helix, the helical pile assembly further comprising a second helix coupled to the pile and extending radially outward therefrom, the second helix being spaced axially apart from the first helix.

6. The helical pile assembly of claim 5, wherein a start point of the first helix is aligned with a start point of the second helix.

7. The helical pile assembly of claim 1, wherein the nose includes a base and a tapered surface, and wherein the helix extends outward from the tapered surface.

8. The helical pile assembly of claim 7, wherein the tapered surface defines an inclination angle of between 15 degrees and 45 degrees.

9. The helical pile assembly of claim 1, further comprising a lateral support device that is coupled to the pile and configured to support the pile in a lateral direction.

10. The helical pile assembly of claim 9, wherein the lateral support device includes a base and a plurality of blades that are circumferentially-offset from one another.

11. The helical pile assembly of claim 10, wherein each blade of the lateral support device includes a tapered end.

* * * * *